US008137513B2

(12) United States Patent
Kato et al.

(10) Patent No.: US 8,137,513 B2
(45) Date of Patent: Mar. 20, 2012

(54) SULFURIC ACID ELECTROLYTIC CELL AND A SULFURIC ACID RECYCLE TYPE CLEANING SYSTEM APPLYING THE SULFURIC ACID ELECTROLYTIC CELL

(75) Inventors: Masaaki Kato, Tamano (JP); Yoshiyuki Seya, Tamano (JP); Naoya Hayamizu, Minato-ku (JP); Makiko Tange, Minato-ku (JP); Yoshiaki Kurokawa, Yokohama (JP); Nobuo Kobayashi, Yokohama (JP)

(73) Assignees: Chlorine Engineers Corp., Ltd., Tokyo (JP); Toshiba Corp., Ltd., Tokyo (JP); Shibaura Mechatronics Corp., Ltd., Kanagawa (JP)

( * ) Notice: Subject to any disclaimer, the term of this patent is extended or adjusted under 35 U.S.C. 154(b) by 432 days.

(21) Appl. No.: 12/459,134

(22) Filed: Jun. 26, 2009

(65) Prior Publication Data

US 2009/0321252 A1 Dec. 31, 2009

(30) Foreign Application Priority Data

Jun. 30, 2008 (JP) ..... 2008-170096

(51) Int. Cl.
*C25B 9/08* (2006.01)
*C25B 11/12* (2006.01)
*C25B 1/28* (2006.01)

(52) U.S. Cl. ..... 204/252; 204/286.1; 204/288.1; 204/288.2; 205/472

(58) Field of Classification Search ..... None
See application file for complete search history.

(56) References Cited

U.S. PATENT DOCUMENTS 4,204,939 A * 5/1980 Boulton et al. ..... 204/258
7,335,284 B2 2/2008 Haenni et al.
2002/0014418 A1* 2/2002 Lehmann et al. ..... 205/472
2004/0146779 A1* 7/2004 Haenni et al. ..... 429/164
(Continued)

FOREIGN PATENT DOCUMENTS

JP 2004-525765 A 8/2004
JP 2006-225694 A 8/2006
JP 2007-262531 A 10/2007
JP 2007-332441 A 12/2007

*Primary Examiner* — Harry D Wilkins, III

(74) *Attorney, Agent, or Firm* — Chapman and Cutler LLP

(57) ABSTRACT

In a sulfuric acid electrolytic cell to electrolyze sulfuric acid supplied to an anode compartment and a cathode compartment comprising a diaphragm, said anode compartment and said cathode compartment separated by said diaphragm, a cathode provided in said cathode compartment and a conductive diamond anode provided in said anode compartment, as said conductive diamond anode, a conductive diamond film is formed on the surface of said conductive substrate, the rear face of said conductive substrate is pasted, with conductive paste, on an current collector comprising a rigid body with size equal to, or larger than, said conductive substrate, an anode compartment frame constituting said anode compartment is contacted via gasket with the periphery on the side of the conductive diamond film of said diamond anode, said diaphragm is contacted with the front face of said anode compartment, further, with the front face of said diaphragm, the cathode compartment frame constituting said cathode compartment, a gasket, and said cathode are contacted in sequence, the rear face of said cathode is pasted with conductive paste to the current collector comprising a rigid body with size equal to, or larger than, said cathode and electric power is supplied from one current collector to the other current collector via said conductive paste.

12 Claims, 2 Drawing Sheets

U.S. PATENT DOCUMENTS

2005/0023227 A1* 2/2005 Rychen et al. ..... 210/748
2007/0029190 A1* 2/2007 Hosonuma et al. ..... 204/280
2007/0031694 A1* 2/2007 Hosonuma et al. ..... 428/621
2008/0110766 A1* 5/2008 Hayamizu et al. ..... 205/472
2009/0218227 A1* 9/2009 Noh et al. ..... 204/666

* cited by examiner

SULFURIC ACID ELECTROLYTIC CELL AND A SULFURIC ACID RECYCLE TYPE CLEANING SYSTEM APPLYING THE SULFURIC ACID ELECTROLYTIC CELL

CROSS-REFERENCE TO RELATED APPLICATIONS

This application is based upon and claims the benefit of priority of Japanese Patent Application 2008-170096, filed on Jun. 30, 2008; the entire contents of which are incorporated herein by reference.

BACKGROUND OF THE INVENTION

1. Field of the Invention

The present invention relates to a sulfuric acid electrolytic cell which forms a solution containing chemical species of oxidation nature through electrolysis of sulfuric acid and a sulfuric acid recycle type cleaning system applying the sulfuric acid electrolytic cell.

2. Description of the Related Art

It is reported that electrolyzed water with oxidation nature or reduction nature being formed through water electrolysis can be utilized in various areas including medical and foods industries.

Also, in the cleaning process of electronics components, cleaning with electrolyzed water commands attention for its less danger in storage or transportation available by the on-site type, and possibility for reducing costs of wastewater treatment, as well.

On the other hand, in the wet cleaning technology applied for washing silicon wafer work such as in the manufacture of semiconductor devices, removal of used photoresist, metals and organic contaminants is commonly performed by SPM in which cleaning is carried out with mixed liquid of sulfuric acid and hydrogen peroxide.

Removal effect of SPM is reported to be deriving from strong oxidizing power of persulfuric acid and mixing heat generated through oxidation while sulfuric acid is mixed with hydrogen peroxide.

Persulfuric acid or persulfate is known to be formed through electrolytic oxidation of sulfuric acid, and has been already electrolytically manufactured on an industrial scale; for instance, acidic sulfate like ammonium persulfate $(NH_4)_2S_2O_8$ has been manufactured by anodic oxidation of ammonium sulfate $(NH_4)_2SO_4$.

The inventors of the present invention have invented the manufacturing method of persulfuric acid by an electrolytic process using a conductive diamond electrode and a cleaning process, as technologies which supply, continuously and quantitatively at a high efficiency, persulfuric acid with a high cleaning effect, and filed for patent (Patent Document 1).

This kind of conductive diamond electrode, which gives larger oxygen over potential, compared with platinum electrodes widely used as electrodes to form persulfate, shows a higher efficiency in electrolytic oxidation of sulfuric acid into persulfuric acid and also a higher chemical stability and a longer electrode life.

In the semiconductor cleaning process, it is essential for the cleaning objects not to be contaminated in view of a higher yield of the products and therefore, chemical solutions whose cleaning effect is stringently controlled are applied. Impurities in sulfuric acid available in the market for the semiconductor manufacturing process have been controlled on the ppb level; however persulfate produced on an industrial level contains impurities as much as over 1000 times, cleanliness level of which, therefore, does not meet at all the level for the semiconductor cleaning process.

The conductive diamond electrode has a construction in which a conductive diamond film is formed as a thin film at a few to hundreds micron in thickness on a conductive substrate with a smooth surface. Electrolytic current supplied via the substrate causes electrochemical reaction at the surface of the conductive diamond film. Although its chemical stability is intrinsic, the mechanical strength of the conductive diamond film, being a thin film, depends on the strength of the substrate.

A conductive diamond film is generally formed by means of CVD method. Film forming is performed in a hydrogen based atmosphere, at over 1000 degrees Celsius; therefore, the substrate is required to withstand these environments with no volume change from corrosion or phase transition. Also, to secure a good adherence between the conductive diamond film and the substrate surface, the coefficient of thermal expansion of the conductive diamond film must be close to that of the substrate.

As the substrate material for a conductive diamond electrode, single-crystal silicon or polycrystalline silicon plate material is used because of said reason, which is generally conductive, has a similar coefficient of thermal expansion to diamond and chemically stable, though such materials as niobium or titanium, superior in corrosion resistance, may sometimes be used.

Electrolytic cells applying conductive diamond electrodes have conventionally been suggested. Mainly applied for the production of chemical substances or water treatment, this type of electrolytic cells with two electrodes arranged oppositely has functions to cause electrochemical reactions on the electrode surface with direct current supplied between electrodes while electrolyte is being supplied to the electrolytic chambers, separated by a diaphragm, of both electrodes.

When the electrolytic cells applying an electrode with a conductive diamond film formed on a silicon substrate is operated, various phenomena occur on the electrode, in addition to electrochemical reaction, including Joule heat generation by electrolytic current, pressure loading by solution supplied, compression by gaskets or O-rings if used for liquid sealing, chemical change in materials such as corrosion through contact with the electrolyte. Conductive diamond electrodes are required to have resistivity against these phenomena.

Under the operating conditions of a conductive diamond electrode, the electrolytic current density is usually below 100 $A/dm^2$ or even at maximum, below 300 $A/dm^2$. Therefore, Joule heat generated under such conditions is presumed below the temperature at which the diamond film is formed, and therefore, as far as Joule heat generated by electrolytic current is removed by electrolyte, any temperature as high as the conductive diamond film and silicon substrate deteriorate will not emerge. However, on the surface of the current collector where electrolytic current is supplied by contacting the substrate, formation of oxide film may be accelerated by Joule heat and contact resistance may be increased with time. Accordingly, such contact is necessary that adherence and conductivity between the current collector and the silicon substrate do not deteriorate even under generation of Joule heat and also no quality change with time occur at the surface of electric feed material by oxidation, etc.

Pressure of feed solution is built up by the liquid supply pump which feeds solution to the electrolytic cells. The pressure increases with increase of the solution amount to be treated, and approximately 0.4 MPa, at maximum, of solution pressure is expected as auxiliary equipment to the cleaning system used in the manufacture of semiconductor device. This pressure is directly applied to the electrode surface, and if deflectable stress is loaded on the electrode, overall cracking may occur.

Tightening compression of gaskets or o-rings is a design pressure required for the electrolytic cells, which is worked out from the volume of feed solution or the pressure by feed solution. Silicon is a material which is relatively hard, but brittle, having cleavage and therefore, the silicon substrate tends to be wholly destroyed once break occurs. This is why this material is better not to be used where impact or stress are applied. In particular, when there is a freely moving end and a supporting point on the silicon substrate, any break or crack occurring from a part of the silicon substrate could develop to a wholly breakage. If the breakage spreads over the entire silicon substrate, and if liquid-sealing by gaskets or o-rings is provided around the periphery of the conductive diamond electrode, the breakage allows electrolyte to leak outside the sealing structure.

As an example of the conventional electrolytic cells applying conductive diamond electrodes, such design is disclosed that disc-shaped diamond electrodes are arranged face to face, being supported by conductive supporting discs, through which electricity is supplied. (Patent Document 2)

In Patent Document 2, the diamond electrode is closely attached to the conductive supporting disc, but as a weak point, pressing force, which makes the conductive supporting disc functioning as sealing part attach to an o-ring seal and a supply washer, is applied by thrust of coil springs and by clamping torque of through bolts. Such pressing force on the electrode surface tends to be uneven because of multiple numbers of coil springs, causing breakage of electrodes or leakage of liquid easily, while, on the other hand, local adjustment is available spot-wise on the electrode surface.

If the electrode attached to the conductive supporting disc is considered as an integral unit, an entire breakage of the electrode is hard to occur when the supporting disc is thick enough, but still breakage is easy to occur where pressing force is locally large. Therefore, the construction of this electrolytic cell has drawback in terms of easy breaking and cracking.

Also, in Patent Document 3, such construction is disclosed that liquid allows to flow without producing short-circuit or passive part on the round-shape electrode, but any description is given neither to diaphragm nor to mechanical consideration to cope with electrode cracking.

Patent Document 4, which is revised version of Patent Documents 2 and 3, does not relate to the construction having diaphragms, and applies elastic conductive metal fibers, etc, having elasticity, being not rigid, softer compared with silicon for the power feeding to the electrode, and therefore when electrodes are subject to a strong pressure by feed solution, etc., breakage by deflection is easy to occur on the entire silicon, since the substrate and current collector do not form an integral unit.

Generally speaking, in case of plate material, thicker is stronger to flexure, and in case of two sheets of plate, integral construction is stronger to flexure. In Patent Document 4, pressing force to the current collector is applied by multiple numbers of springs and conductive metal fiber construction having elasticity, as with the method by Patent Document 2, and therefore, similar problems to Patent Document 2 could occur. Whereas, the specification explains that in order to obtain uniform pressing force, conductive metal fibers are employed; however, in fact, conductive metal fibers have elasticity, which allows significant change in thickness by pressing force and therefore, it should be difficult to compress the large area to a uniform thickness. In view of this, the displacement in thickness with the electrolytic cells described in Patent Document 4 will cause deflection, which will lead to generation of cracking. In addition, compression deformation of conductive metal fibers generates resistance by conductive metal fibers themselves or distribution of contact resistance by conductive metal fibers with diamond electrodes or with the current collector, which leads to uneven distribution of electrolytic current or Joule heat, eventually causing local loading on electrodes or electrolytic cells or variation in performance.

When electrolysis products are obtained through electrolysis of sulfuric acid, oxidizing substance is formed at the anode through electrolytic oxidation of substance contained in electrolyte, and reducing substance is formed at the cathode through electrolytic reduction of substance contained in electrolyte. If these two kinds of materials are made contacted, each substance may return to its initial substance through oxidation and reduction, and therefore, if no diaphragm exists in the electrolytic cells, as with afore-mentioned Patent Documents 3 and 4, it is considered that electrolytic products, after electrolysis, contained in the electrolyte, immingle and are subjected to oxidation and reduction reactions with each other to return to respective initial substances or form different substances from electrolytic products, and are drained outside the electrolytic cells. This type of electrolytic cells using no diaphragm will achieve inefficient performance as a reaction system.

[Patent Document 1] Tokkai 2007-332441 Patent Gazette
[Patent Document 2] Tokkai 2004-525765 Patent Gazette
[Patent Document 3] Tokkai 2006-225694 Patent Gazette
[Patent Document 4] Tokkai 2007-262531 Patent Gazette

SUMMARY OF THE INVENTION

The present invention aims at providing a sulfuric acid electrolytic cell and a sulfuric acid recycle type cleaning system applying the sulfuric acid electrolytic cell which eliminate said technical weak points of the conventional technology, are superior in mechanical strength, can withstand severe electrolysis conditions, prevent corrosion by electrolyte and give high durability.

In order to solve said problems, the present invention provides a sulfuric acid electrolytic cell to electrolyze sulfuric acid supplied to an anode compartment and a cathode compartment comprising a diaphragm, said anode compartment and said cathode compartment separated by said diaphragm, a cathode provided in said cathode compartment and a conductive diamond anode provided in said anode compartment, characterized in that, as said conductive diamond anode, a conductive diamond film is formed on the surface of said conductive substrate; the rear face of said conductive substrate is pasted, with conductive paste, on a current collector comprising a rigid body with size equal to, or larger than, said conductive substrate; an anode compartment frame constituting said anode compartment is contacted via gasket with the periphery on the side of the conductive diamond film of said diamond anode; said diaphragm is contacted with the front face of said anode compartment; further, with the front face of said diaphragm, the cathode compartment frame constituting said cathode compartment, a gasket, and said cathode are contacted in sequence; the rear face of said cathode is pasted with conductive paste to the current collector comprising a rigid body with size equal to, or larger than, said cathode; and electric power is supplied from one current collector to the other current collector via said conductive paste.

Furthermore, in order to solve said problems, the present invention provides a sulfuric acid recycle type cleaning system applying a sulfuric acid electrolytic cell, characterized in that said sulfuric acid electrolytic cell and a cleaning tank are provided wherein said cleaning tank washes cleaning objects using, as cleaning liquid, a treatment liquid comprising a solution containing chemical species of oxidation nature produced by said sulfuric acid electrolytic cell; and a circulation line is provided between said cleaning tank and said sulfuric acid electrolytic cell to recycle said treatment liquid.

According to the present invention, a sulfuric acid electrolytic cell and a sulfuric acid recycle type cleaning system applying the sulfuric acid electrolytic cell which are superior in mechanical strength, prevent corrosion by electrolyte and a give high durability, can be offered.

DETAILED DESCRIPTION OF THE INVENTION

Figure 1:
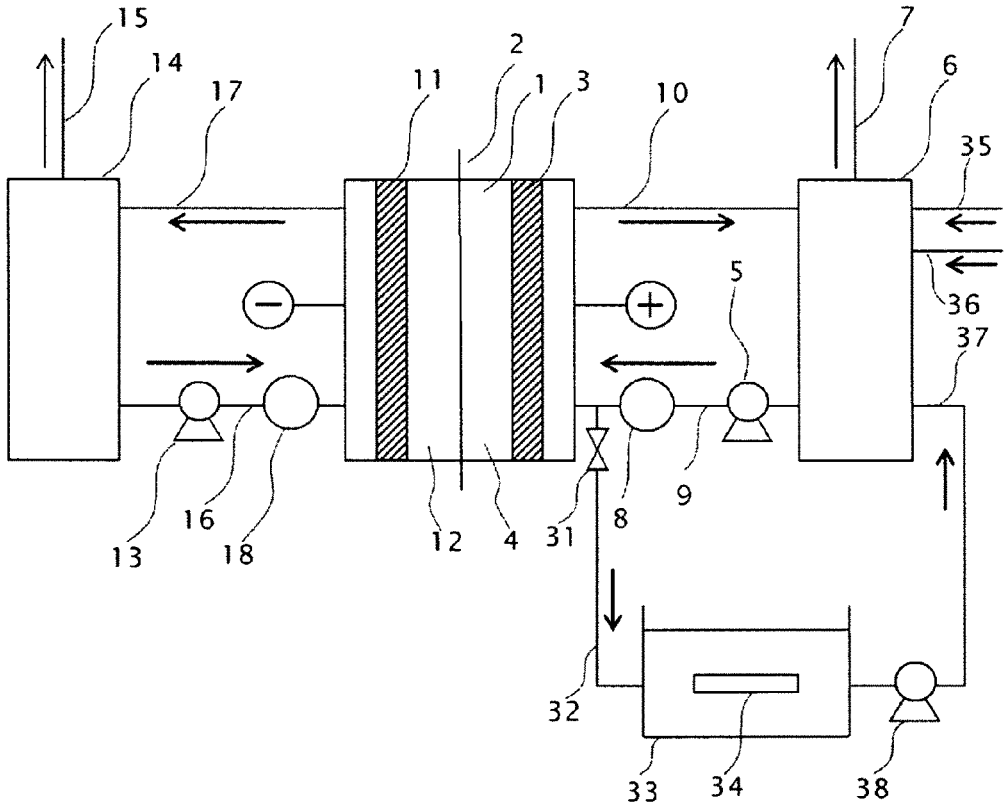
[FIG. 1] An overall diagram illustrating an example of the sulfuric acid recycle type cleaning system applying the sulfuric acid electrolytic cell by the present invention.
Figure 2:
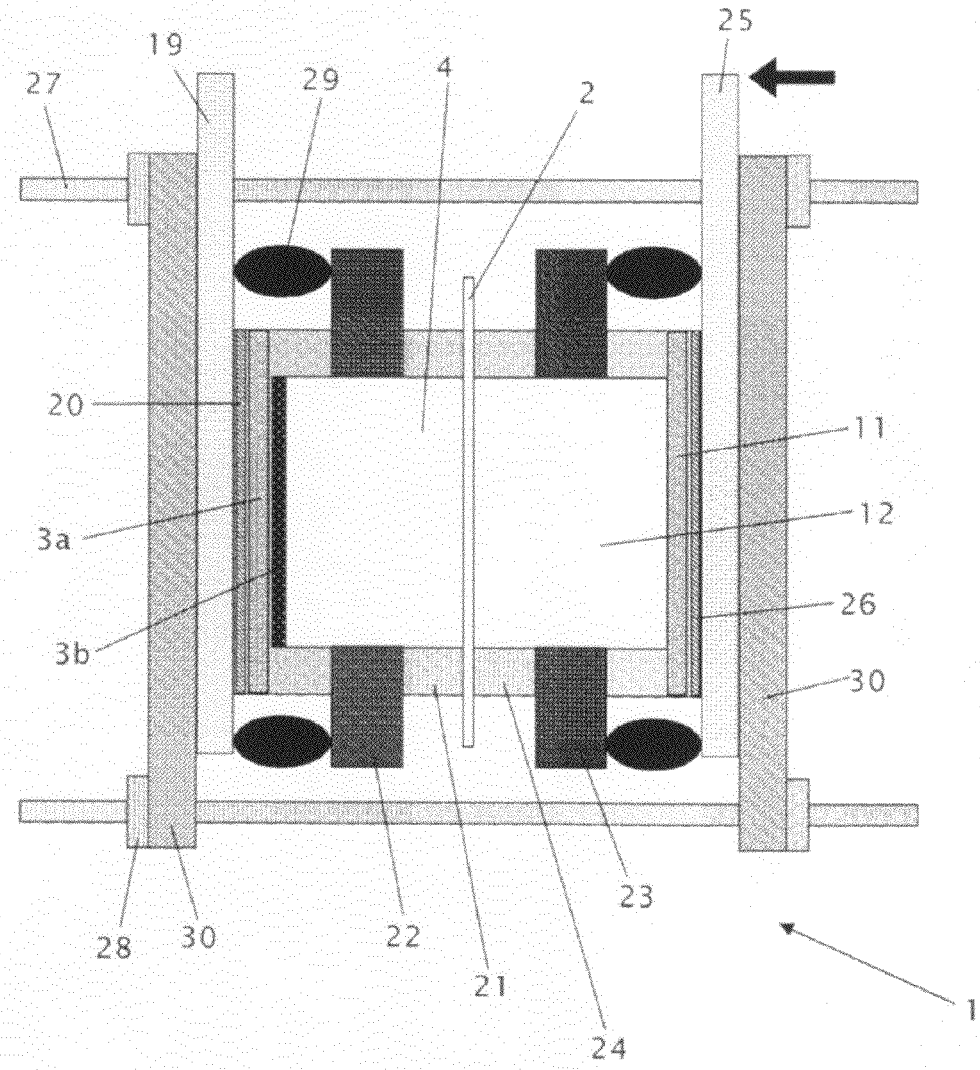
FIG. 2 A drawing illustrating an example of the sulfuric acid electrolytic cell of the present invention.

The following explains an example of the present invention in reference to FIG. 1 and FIG. 2.

FIG. 1 shows an example of the sulfuric acid electrolytic cell land the sulfuric acid recycle type cleaning system applying the electrolytic cell 1 by the present invention. Concentrated sulfuric acid and ultrapure water are supplied to the anolyte tank 6 through the concentrated sulfuric acid feed line 35 and the ultrapure water feed line 36, followed by being prepared to a desired concentration, and supplied to the anode compartment 4 of the sulfuric acid electrolytic cell 1, where electrolysis is performed. This electrolytic cell 1 is separated by the diaphragm 2 into the anode compartment 4 accommodating the conductive diamond anode 3 and being filled with concentrated sulfuric acid and the cathode compartment 12 accommodating the cathode 11 and being filled with dilute sulfuric acid. The system is constructed in such a way that to the anode compartment 4, the anolyte supply line 9 is connected, and through the anolyte supply lines 9 and 10, sulfuric acid, which is anolyte, is circulated between the anode compartment 4 and the anolyte tank 6 by the anolyte circulation pump 5. Similarly, to the cathode compartment 12, the catholyte supply line 16 is connected, and through the catholyte supply lines 16 and 17, catholyte is circulated between the cathode compartment 12 and the catholyte tank 14 by the catholyte circulation pump 13.

Other components include the anode gas vent line 7, the anolyte flow meter & pressure gauge 8, the cathode gas vent line 15, and the catholyte flow meter & pressure gauge 18.

In the present invention, the conductive diamond anode 3 is used as anode and concentrated sulfuric acid is electrolyzed by this conductive diamond anode 3. The conductive diamond anode 3 has a higher oxygen overpotential compared with platinum electrode or lead dioxide electrode (platinum: several hundreds mV; lead dioxide: approx. 0.5V; conductive diamond: approx. 1.4V) and through reaction with water, it generates oxygen or ozone, as shown in the reaction equations (1) and (2). Moreover, if sulfuric acid ions or hydrogen sulfate ions exist in the anolyte, the conductive diamond anode 3 generates, through reaction with these ions, persulfuric acid ion, as shown in the reaction equations (3) and (4).

| | | |
|---|---|---|
| $2H_2O \rightarrow O_2 + 4H^+ + 4e^-$ | (1.23 V) | (1) |
| $3H_2O \rightarrow O_3 + 6H^+ + 6e^-$ | (1.51 V) | (2) |
| $2SO_4^{2-} \rightarrow S_2O_8^{2-} + 2e^-$ | (2.01 V) | (3) |
| $2HSO_4^- \rightarrow S_2O_8^{2-} + 2H^+ + 2e^-$ | (2.12 V) | (4) |

As afore-mentioned, these reactions of oxygen generation reaction by water electrolysis and formation of persulfuric acid ion by oxidation of sulfuric acid ion are competing reactions, but if the conductive diamond anode 3 is applied, the formation of persulfuric acid ion precedes.

This is attributed to the facts that the conductive diamond anode 3 has an extremely broad potential window; the over potential to oxygen generation reaction is high; and the targeted oxidation reaction stays within the potentially progressive range, and therefore, if electrolysis of the aqueous solution containing sulfuric acid ion is performed, persulfuric acid forms at a high current efficiency, while oxygen generation is only little to occur.

The reason why the oxygen overpotential is high with the conductive diamond anode 3 can be explained as follows. On an ordinary electrode surface, water is first oxidized to form oxygen chemical species and from this oxygen chemical species, oxygen or ozone is considered to be formed. On the other hand, diamond is chemically more stable than ordinary electrode material, and uncharged water is hard to adsorb to the surface and therefore, oxidation of water is considered little to occur. By contrast, sulfuric acid ion, which is anion, is easy to adsorb to the surface of diamond, functioning an anode, even at a low potential, and presumably the forming reaction of persulfate ion is more to occur than oxygen generation reaction.

FIG. 2 illustrates an example of the sulfuric acid electrolytic cell 1 by the present invention. The conductive diamond anode 3 applied under the present invention is manufactured by supporting the conductive diamond film 3*b*, which is reduction deposit of organic compounds, as carbon source, on the conductive substrate 3*a*. The material and shape of said substrate 3*a* are not specifically limited as far as the material is conductive and can be either in plate, mesh, or for instance, porous plate of bibili fiber sintered body, comprising conductive silicon, silicon carbide, titanium, niobium and molybdenum, and as material of the conductive substrate 3*a*, use of conductive silicon or silicon carbide is preferable because of its similar thermal expansion rate to the conductive diamond film 3*b*. Moreover, in order to enhance adherence between the conductive diamond film 3*b* and the substrate 3*a*, and also to increase surface area of the conductive diamond film 3*b* to lower current density per unit area, the surface of the substrate 3*a* should preferably be rough to a certain extent.

When the conductive diamond film 3*b* is used in membrane, the thickness of membrane should preferably be 10 μm-50 μm to increase durability and to reduce pin-hole development. More than 100 μm thick self-supported membrane is applicable in view of durability, but cell voltage becomes too high, rendering the temperature control of electrolysis solution to be more complicated.

The method to support the conductive diamond film 3*b* to the substrate 3*a* has no specific limitation and is optional from among conventional methods. Typical manufacturing methods of the conductive diamond film 3*b* include the hot filament CVD (chemical deposition), microwave plasma CVD, plasma arcjet, and physical vapor deposition method (PVD), with the microwave plasma CVD being desirable in view of a higher film-making rate and uniform film preparation.

Among other applicable is the conductive diamond anode 3 with the conductive diamond film 3*b* bonded using resin, etc. on the substrate 3*a* applying synthetic diamond powder manufactured by using ultra-high pressure. In particular, if hydrophobic ingredient, such as fluororesin, is present on the electrode surface, sulfuric acid ion, which is the object of treatment, is easy to be trapped, leading to enhanced reaction efficiency.

The microwave plasma CVD method is the process in which the hydrogen-diluted mixture gas of carbon source like methane and dopant source like diborane is introduced to the reaction chamber, connected with a microwave transmitter via a waveguide, in which film forming substrate of the conductive diamond anode 3, such as conductive silicon, alumina and silicon carbide is installed, so that plasma is generated within the reaction chamber to develop conductive diamond on the substrate. Ions by microwave plasma do not oscillate, and chemical reaction is effected at a pseudo-high temperature condition where only electrons are made oscillated. Output of plasma is 1-5 kW, the larger the output, the more the active species can be generated and the rate of diamond growth accelerated. Advantage of using plasma lies in the fact that diamond filming is possible at a high speed on a large surface area substrate.

For providing conductivity to the conductive diamond anode 3, a trace amount of elements having different atomic value is added. The content of boron or phosphorus is preferably 1-100000 ppm, or more preferably 100-10000 ppm. As the basic ingredient for this additive element, boron oxide or phosphorus pentoxide, which is less toxic, is applicable. The conductive diamond anode 3, thus manufactured and supported on the substrate, can be connected to the current collector comprising conductive substances, such as titanium, niobium, tantalum, silicon, carbon, nickel and tungsten carbide, in a configuration of flat plate, punched plate, metal mesh, powder-sintered body, metal fiber, metal fiber-sintered body, etc.

The sulfuric acid electrolytic cell 1 is configured to be a 2-chamber type electrolytic cell, separated into the anode compartment 4 and the cathode compartment 12 by a reinforced ion exchange membrane or a diaphragm 2 of porous resin membrane subjected to hydrophilic treatment, so that persulfuric acid ions formed at the conductive diamond anode 3 will not be reduced to sulfuric acid ions through the contact with the cathode 11.

The material of the cell frame of the sulfuric acid electrolytic cell 1 should preferably be high-temperature-tolerant and high-chemical resistant PTFE or New PFA in view of durability. As the sealing material, porous PTFE, or rubber sheets or O-rings coated with PTFE or New PFA, such as Gore-Tex or Poreflon. Also, for enhancing sealing effect, the cell frame should preferably be v-notched or be given projection processing.

The cathode 11 applied in the present invention is a hydrogen generation electrode or an oxygen gas electrode, necessary to have durability to concentrated sulfuric acid. Applicable materials include as with the conductive diamond anode 3, conductive diamond with conductive diamond film, which is reduction deposit of organic compound as carbon source on the conductive substrate, conductive silicon, glass-state carbon, and those materials coated with precious metals. In case of an oxygen gas electrode, oxygen supply is controlled to 1.2-10 times of the theoretical amount.

As the cathode 11 applied in the present invention, a conductive diamond cathode is preferable. When a conductive diamond is used for the cathode 11, the manufacturing process is the same as that for the conductive diamond anode 3. Also, if a conductive diamond cathode is applied as the cathode 11, the use of silicon substrate is preferable as with the conductive diamond anode 3

As the diaphragm 2, the neutral membranes, such as trade name-Poreflon, or cation exchange membranes, such as trade names-Nafion, Aciplex, and Flemion are applicable; however, in view of the fact that the product in each compartment can be manufactured separately, use of cation exchange membranes, the latter, is preferable, with an additional advantage that cation exchange membrane can promote electrolysis even when the conductivity of electrolysis solution is low. To minimize the effect from concentration gradient of water and to decrease the cell voltage, desirable cation exchange membranes include those with packing (reinforcing cloth) with dimensional stability even at low moisture content; those of 50 μm or less in thickness; and those of no laminated layers of ion exchange membranes. In the coexistence with a substance of low equilibrium vapor pressure, like sulfuric acid at 96% by mass, ion exchange membrane shows low moisture content and an increased specific resistance value leading to a problem of increased electrolysis cell voltage. When highly-concentrated sulfuric acid like 96% by mass is supplied to the anode compartment 4 to obtain persulfuric acid at a high efficiency, it is desirable to supply sulfuric acid at 70% or below by mass to the cathode compartment 12 in order to supply water to ion exchange membrane.

In the present invention, resin membranes subjected to hydrophilic treatment with IPA (isopropyl alcohol) is applicable as the diaphragm 2, other than ion exchange membranes. Porous fluororesin membranes marketed under the trade names Gore-Tex or Poreflon do not perform electrolysis without hydrophilic treatment, such as with IPA treatment. Said porous fluororesin membranes are hydrophobic and neither permeation of sulfuric acid solution nor proceeding of electrolysis is possible. If this porous fluororesin membrane undergoes hydrophilic treatment, said resin membrane turns to be capable of containing water or concentrated sulfuric acid and electric conduction by sulfuric acid becomes possible, enabling to function as electrolytic cell diaphragm. Porous fluororesin membranes without this treatment keep air in the holes, being unable to conduct electricity, and electrolysis does not proceed. In case that resin membranes subjected to hydrophilic treatment are used as diaphragm, diaphragm itself shows no resistance and electrolysis is performed at a low electrolytic cell voltage, although formed products in both compartments slightly mingle, compared with the case in which ion exchange membranes are used as diaphragm.

Porous alumina plates commonly used as diaphragm in the production of persulfate are also applicable with enough durability in the electrolytic cell disclosed in the present specifications; however, impurities from porous alumina plates mingle in the electrolysis solution, and therefore, this type of diaphragm cannot be used for the production of semiconductor cleaning liquid.

This diaphragm 2 can be sandwiched between two sheets of protection board, made of PTFE or new PFA on which holes are punched or in the form of expanded mesh.

The conductive diamond anode 3 has a large oxidative power and organic substance in contact with anodically polarized conductive diamond surface is decomposed to convert to mostly carbon dioxide. The diaphragm 2 in the sulfuric acid electrolytic cell 1 vibrates between the anode and the cathode under the output pressure of the liquid supply pump used for liquid supply to the sulfuric acid electrolytic cell 1 and therefore, if said protection board is not provided, the diaphragm 2 may possibly consume in contact with the conductive diamond anode 3. Also, if vibration occurs while the protection board is not provided, the clearance between the electrode and the diaphragm varies and cell voltage may fluctuate.

As other embodiment of the present invention, the treatment liquid comprising a solution containing chemical species of oxidation nature, produced by the sulfuric acid electrolytic cell 1, is used as cleaning liquid. The treatment liquid comprising a solution containing chemical species of oxidation nature, produced by the sulfuric acid electrolytic cell 1 is supplied, via the cleaning chemical solution supply valve 3 land the chemical solution supply line 32, to the cleaning tank 33, where the cleaning object 34 is washed. Then, the cleaning liquid after use is recycled to the anode tank 6 via the recycle pump 38 and the recycle line 37.

In FIG. 2, the conductive diamond film 3*b* is formed on the surface of conductive substrate 3*a*, to form the conductive diamond anode 3, and the rear face of said conductive substrate 3*a* is attached, with the conductive paste 20, to the current collector 19 comprising a rigid body with an equal or larger size to said conductive substrate 3*a*. When the conductive substrate 3*a* and the current collector 19 are stacked, the entire surface of the conductive substrate 3*a* must be exactly laid on the surface of the current collector 19, or the surface of the current collector 19 may remain a little after the entire surface of the conductive substrate 3*a* is stacked. Then, the anode compartment frame 22 constituting said anode compartment 4 is contacted via gasket 21 with the periphery on the side of the conductive diamond film 3*b* of said conductive diamond anode 3; said diaphragm 2 is contacted with the front face of said anode compartment frame 22; cathode compartment frame 23 constituting said cathode compartment 12, gasket 24 and said cathode 11 are contacted, one by one, with the front face of said diaphragm 2; the rear face of said cathode 11 is attached to the current collector 25 comprising a rigid body with an equal or larger size to said cathode 11 with the conductive paste 26; and electricity is supplied from said current collector 19 at one side to the current collector 25 at the other, via said conductive paste 20, 26.

In order to give practical mechanical strength to the conductive substrate 3*a* on which the conductive diamond film 3*b* is formed, it is desirable to have a thickness of 1 mm or more. To avoid the end of the conductive diamond anode 3 being a free end, it is necessary for the conductive substrate 3*a* to be supported by the current collector 19 comprising a rigid body with a size equal to, or larger than, that of the conductive substrate 3*a*. For the conductive substrate 3*a*, either single-crystal silicon or polycrystalline silicon is applicable. Though single-crystal is easy to develop cleavage, there is no significant difference in mechanical strength or breakage. The rigid body constituting the current collector 19 should desirably have the thickness equal to, or thicker than, that of the conductive substrate 3*a*. Metal plates, such as of copper, aluminum, titanium, and stainless steel are applicable with features of little deformation or breaking to stress and a high electric conductivity. Also, in an attempt to minimize contact resistance between the conductive substrate 3*a* and the current collector 19 and to suppress changes as surface oxidation, corrosion, etc. by Joule heat generation or liquid spill, precious metal coating also is desirably provided on the surface of current collector and the rear face of the conductive diamond filming face of the silicon substrate.

The constructions on the anode side and the cathode side with the diaphragm 2 placed in-between should be preferably symmetrical, i.e. with same size and construction.

It is desirable that the conductive substrate 3*a* and the current collector 19 are bonded by means of pasting so as to have mechanical strength as an integral rigid body. Also, to minimize the change of contact resistance by Joule heat, welding, soldering and conductive paste 20, 26 are applicable. Among them, conductive paste is the most desirable for its easiness of bonding by a simple method of application. For the conductive paste 20, 26, either the polymer-type which leaves resin ingredients during coating or the high-temperature baking-type which does not leave resin ingredient is serviceable; however, polymer-type, which gives adherence without involving high-temperature heat treatment and has heat resistance up around 200 degree Celsius is preferable. Also, as conductive element for conductive paste, precious metals including platinum and palladium, besides silver and copper, are applicable.

The current collector 19, 25 installed on the each side of the conductive diamond anode 3 and said cathode 11, respectively are tied to the end plate 30 by using the electrolytic cell clamp bolt 27 and the electrolytic cell clamp nut 28. If sealing is possible by applying crush pressure to the gasket, the fastening method is not limited to the method by through bolts and clamp nuts. For instance, such method for sealing is applicable that the gasket is pressurized and crushed by a hydraulic power unit from external of the cell press of the electrolytic cell Also, such configuration is possible that the current collectors are installed on the both sides of multiple units arranged, where one unit means the elements provided between the conductive diamond anode 3 and the said cathode 11.

If the current collector 19, 25 is made larger than the conductive diamond anode 3 and the cathode 11; the auxiliary gasket 29 is provided to the periphery of said current collector 19, 25; and the conductive diamond anode 3 and the cathode 11 are fastened by said auxiliary gasket 29, leakage can be prevented by the auxiliary gasket 29, when unexpected breakage of silicon material of the conductive substrate 3 should occur.

In the following, the present invention is explained in reference to examples and comparison examples; provided, however, the present invention is not limited to these examples.

EXAMPLE 1

On a silicon base material (substrate) of 3 mm thick, 6 inch diameter, a diamond layer of 20 μm was formed by the microwave plasma CVD method applying methane and diborane (10000 ppm to methane) as raw material to be used as the conductive diamond anode. A proper amount of conductive paste (Fujikura Kasei D 550) was applied as adhesive agent over the entire area of the rear face of this anode; and this anode was attached to the center part of the copper current collector of 17 cm dia. with a conductive rib and underwent the hardening treatment for 30 minutes at 100 degree Celsius in an oven to obtain an current collector with a conductive diamond anode and an current collector with a conductive diamond cathode.

Then, an end plate, an current collector with a conductive diamond anode, a porous PTFE gasket, a cell frame, a porous PTFE gasket, a diaphragm, a porous PTFE gasket, a cell frame, a porous PTFE gasket, an current collector with a conductive diamond cathode, and an end plate were stacked in sequence, which were fastened by clamp bolts and nuts. The electrolysis area of this electrolytic cell is approx. 1 $dm^2$.

This electrolytic cell 1 is divided by the diaphragm 2 into the anode compartment 4 where the conductive diamond anode 3 is accommodated and concentrated sulfuric acid is filled and the cathode compartment 12 where the cathode 11 is accommodated and dilute sulfuric acid is filled. The system is configured in such a way that to the anode compartment 4, the anolyte supply line 9 is connected, through which sulfuric acid, as anolyte, is circulated by the anolyte circulation pump 5 between the anode compartment 4 and the anolyte tank 6. Also, to the cathode compartment 12, the catholyte supply line 16 is connected, through which catholyte is circulated by the catholyte circulation pump 13 between the cathode compartment 12 and the catholyte tank 14.

Using this electrolytic cell 1, persulfuric acid was produced under the following conditions. Electrolysis solution was circulated by an aired pump.

Current density: 40 A/dm$^2$

Anode circulatory fluid: 96% by mass EL sulfuric acid (by Kanto Kagaku K. K.)

Cathode circulatory fluid: 70% by mass sulfuric acid (Prepared by diluting anode circulatory fluid with pure water)

Anolyte pump discharge pressure: 0.25 MPa (Circulatory fluid flow rate: Approx. 1 L/min.)

Catholyte pump discharge pressure: 0.25 MPa (Circulatory fluid flow rate: Approx. 1 L/min.)

Initial anolyte temperature: 30 degree Celsius

Initial catholyte temperature: 30 degree Celsius

Electrolysis time: 60 min.

In the continuous electrolysis for 60 minutes, the electrolyte temperature at either electrode became approx. 80 degree Celsius, but neither electrode damage nor leak of electrolysis solution was observed. The cell voltage at the start of electrolysis was 12 V.

COMPARATIVE EXAMPLE 1

On a silicon base material (substrate) of 3 mm thick, 6 inch diameter, a diamond layer of 20 μm was formed by the microwave plasma CVD method applying methane and diborane (10000 ppm to methane) as raw material to be used as the conductive diamond anode and the conductive diamond cathode.

Then, an end plate, stainless steel fiber sintered plate, a conductive diamond electrode, a porous PTFE gasket, a PTFE cell frame, a porous PTFE gasket, a diaphragm, a porous PTFE gasket, a PTFE cell frame, a porous PTFE gasket, a conductive diamond electrode, a stainless steel fiber sintered plate and an end plate were stacked in sequence, which were fastened by clamp bolts and nuts. The electrolysis area of this electrolytic cell is approx. 1 dm$^2$. For both anode and cathode, a conductive diamond electrode was used. The applied stainless steel fiber sintered plate was casted by sintering 10 μm stainless steel fiber to 6 inch ϕ×3 mm t with the porosity of 70%

Using the same equipment (Test Unit) as with Example 1, electrolysis test was conducted.

Current density: 40 A/dm$^2$

Anode circulatory fluid: 96% by mass EL sulfuric acid (by Kanto Kagaku K. K.)

Cathode circulatory fluid: 70% by mass sulfuric acid (Prepared by diluting anode circulatory fluid with pure water)

Anolyte pump discharge pressure: 0.25 MPa (Circulatory fluid flow rate: Approx. 1 L/min.)

Catholyte pump discharge pressure: 0.25 MPa (Circulatory fluid flow rate: Approx. 1 L/min.)

Initial anolyte temperature: 30 degree Celsius

Initial catholyte temperature: 30 degree Celsius

In 15 minutes after the start of electrolysis, electrolysis solution began to leak and the test was terminated.

The inspection of the disassembled electrolytic cell proved that the anode was finely and plentifully cracked over the entire surface and along cracked lines, electrolysis solution leaked outside the electrolytic cell. The stainless steel fiber sintered plate was corroded with leaked electrolysis solution and the plate of 3 mm thick before the cell assembly was deformed unevenly to 2.6-2.8 mm thick. The cell voltage at the start of the electrolysis was 18 V.

COMPARATIVE EXAMPLE 2

On a silicon base material (substrate) of 3 mm thick, 6 inch diameter, a diamond layer of 20 μm was formed by the microwave plasma CVD method applying methane and diborane (10000 ppm to methane) as raw material to be used as the conductive diamond anode and the conductive diamond cathode.

Then, an end plate, titanium fiber sintered plate, a conductive diamond electrode, a porous PTFE gasket, a cell frame, a porous PTFE gasket, a diaphragm, a porous PTFE gasket, a cell frame, a porous PTFE gasket, a conductive diamond electrode, a titanium fiber sintered plate and an end plate were stacked in sequence, which were fastened by clamp bolts and nuts. The electrolysis area of this electrolytic cell is approx. 1 dm$^2$. For both anode and cathode, a conductive diamond electrode was used. The applied titanium fiber sintered plate was casted by sintering 250 μm titanium fiber to 6 inch ϕ×2.5 mm t with the porosity of 70%

Using the same equipment (Test Unit) as with Example 1, electrolysis test was conducted.

Current density: 40 A/dm$^2$

Anode circulatory fluid: 96% by mass EL sulfuric acid (by Kanto Kagaku K. K.)

Cathode circulatory fluid: 70% by mass sulfuric acid (Prepared by diluting anode circulatory fluid with pure water)

Anolyte pump discharge pressure: 0.25 MPa (Circulatory fluid flow rate: Approx. 1 L/min.)

Catholyte pump discharge pressure: 0.25 MPa (Circulatory fluid flow rate: Approx. 1 L/min.)

Initial anolyte temperature: 30 degree Celsius

Initial catholyte temperature: 30 degree Celsius

In 5 minutes after the start of electrolysis, electrolysis solution began to leak and the test was terminated.

The inspection of the disassembled electrolytic cell proved that a crack was running from one periphery to the other periphery through the center of the anode, through which electrolysis solution leaked outside the electrolytic cell. The titanium fiber sintered plate discolored with leaked electrolysis solution, with no change in the plate thickness, 2.5 mm. The cell voltage at the start of the electrolysis was 20 V.

EXAMPLE 2

On a silicon base material (substrate) of 3 mm thick, 6 inch diameter, a diamond layer of 20 μm was formed by the microwave plasma CVD method applying methane and diborane (10000 ppm to methane) as raw material to be used as the conductive diamond electrode. A proper amount of conductive paste (Fujikura Kasei D 550) was applied as adhesive agent over the entire area of the rear face of this electrode; and this electrode was attached to the center part of the copper current collector of 17 cm dia. with a conductive rib and underwent the hardening treatment for 30 minutes at 100 degree Celsius in an oven to obtain an current collector with a conductive diamond anode and an current collector with a conductive diamond cathode.

Then, an end plate, an current collector with a conductive diamond electrode, a porous PTFE gasket of 5.6 inch periphery dia. and 1.0 cm periphery width and a Viton o-ring of 6 inch periphery dia. and 2 mmϕ cross section dia. (=gasket+o-ring), a PTFE cell frame, (gasket+o-ring), a diaphragm, a porous PTFE gasket, a PTFE cell frame, a porous PTFE gasket, an current collector with a conductive diamond electrode, and an end plate were stacked in sequence, which were fastened by clamp bolts. The electrolysis area of this electrolytic cell is approx. 1 $dm^2$. For both anode and cathode, a conductive diamond electrode was used. The gasket part was configured in such a way that an o-ring was arranged outside and an PTFE soft sheet is arranged inside, concentrically.

Using the same equipment (Test Unit) as with Example 1, electrolysis test was conducted.

Current density: 40 $A/dm^2$

Anode circulatory fluid: 96% by mass EL sulfuric acid (by Kanto Kagaku K. K.)

Cathode circulatory fluid: 70% by mass sulfuric acid (Prepared by diluting anode circulatory fluid with pure water)

Anolyte pump discharge pressure: 0.25 MPa (Circulatory fluid flow rate: Approx. 1 L/min.)

Catholyte pump discharge pressure: 0.25 MPa (Circulatory fluid flow rate: Approx. 1 L/min.)

Initial anolyte temperature: 30 degree Celsius

Initial catholyte temperature: 30 degree Celsius

Electrolysis time: 60 min.

In the electrolysis for 60 minutes, the temperature of both anolyte and catholyte became about 80 degree Celsius, but neither electrode damage nor leak of electrolysis solution was observed. The cell voltage at the start of electrolysis was 12 V.

FIGURE LEGEND

1: sulfuric acid electrolytic cell
2: diaphragm
3: conductive diamond anode
3*a*: conductive substrate
3*b*: conductive diamond film
4: anode compartment
5: anolyte circulation pump
6: anolyte tank
7: anode gas vent line
8: anolyte flow meter & pressure gauge
9, 10: anolyte supply line
11: cathode
12: cathode compartment
13: catholyte circulation pump
14: catholyte tank
15: cathode gas vent line
16: catholyte supply line
17: catholyte circulation line
18: catholyte flow meter & pressure gauge
19: current collector
20: conductive paste
21: gasket
22: anode compartment frame
23: cathode compartment frame
24: gasket
25: current collector
26: conductive paste
27: electrolytic cell clamp bolt
28: electrolytic cell clamp nut
29: auxiliary gasket
30: end plate
31, 32: cleaning chemical solution supply valve
33: cleaning tank
34: cleaning object
35: concentrated sulfuric acid feed line
36: ultrapure water feed line
37: recycle line
38: recycle line pimp

The invention claimed is:

1. A sulfuric acid electrolytic cell to electrolyze sulfuric acid, comprising an anode compartment and a cathode compartment to which said sulfuric acid is supplied, a diaphragm, with said anode compartment and said cathode compartment being separated by said diaphragm, a cathode provided in said cathode compartment, and a conductive diamond anode provided in said anode compartment, wherein:

said conductive diamond anode comprises a conductive diamond film formed on a surface of a conductive substrate;

a rear face of said conductive substrate is pasted, with conductive paste, on a first current collector comprising a rigid body with a size equal to, or larger than, said conductive substrate;

an anode compartment frame constituting said anode compartment is contacted via a first gasket with a periphery on a side of said conductive diamond film of said diamond anode;

said diaphragm is contacted with a front face of said anode compartment;

with a front face of said diaphragm, a cathode compartment frame constituting said cathode compartment, a second gasket, and said cathode, are contacted in sequence;

a rear face of said cathode is pasted with conductive paste to a second current collector comprising a rigid body with a size equal to, or larger than, said cathode; and electric power is supplied from said first current collector to said second current collector via said conductive paste.

2. The sulfuric acid electrolytic cell as defined in claim 1, wherein said cathode is a conductive diamond cathode comprising a conductive diamond film formed on a surface of a conductive substrate, a rear face of said conductive substrate being pasted with conductive paste to said second current collector.

3. The sulfuric acid electrolytic cell as defined in claim 1, wherein said conductive substrate is a silicon substrate.

4. The sulfuric acid electrolytic cell as defined in claim 1, wherein said first and second current collectors are installed, respectively, on a rear face of said anode and on the rear face of said cathode, and are fastened by clamping bolts and nuts for said electrolytic cell.

5. The sulfuric acid electrolytic cell as defined in claim 1, wherein elements from the rear face of said anode to the rear face of said cathode are defined as a unit, and said electrolytic cell comprises a plurality of said units arranged between said first and second current collectors installed on each end.

6. The sulfuric acid electrolytic cell as defined in claim 1, wherein said first and second current collectors are larger than said anode and said cathode; auxiliary gaskets are provided at peripheries of said first and second current collectors; and said anode and said cathode are fixed by said auxiliary gaskets.

7. A sulfuric acid recycle type cleaning system applying a sulfuric acid electrolytic cell, comprising: a sulfuric acid electrolytic cell as defined in claim 1; a cleaning tank, wherein said cleaning tank washes cleaning objects using, as a cleaning liquid, a treatment liquid comprising a solution containing chemical species of oxidation nature produced by said sulfuric acid electrolytic cell; and a circulation line arranged between said cleaning tank and said sulfuric acid electrolytic cell to recycle said treatment liquid.

8. A sulfuric acid recycle type cleaning system applying a sulfuric acid electrolytic cell, comprising: a sulfuric acid electrolytic cell as defined in claim 2; a cleaning tank, wherein said cleaning tank washes cleaning objects using, as a cleaning liquid, a treatment liquid comprising a solution containing chemical species of oxidation nature produced by said sulfuric acid electrolytic cell; and a circulation line arranged between said cleaning tank and said sulfuric acid electrolytic cell to recycle said treatment liquid.

9. A sulfuric acid recycle type cleaning system applying a sulfuric acid electrolytic cell, comprising: a sulfuric acid electrolytic cell as defined in claim 3; a cleaning tank, wherein said cleaning tank washes cleaning objects using, as a cleaning liquid, a treatment liquid comprising a solution containing chemical species of oxidation nature produced by said sulfuric acid electrolytic cell; and a circulation line arranged between said cleaning tank and said sulfuric acid electrolytic cell to recycle said treatment liquid.

10. A sulfuric acid recycle type cleaning system applying a sulfuric acid electrolytic cell, comprising: a sulfuric acid electrolytic cell as defined in claim 4; a cleaning tank, wherein said cleaning tank washes cleaning objects using, as a cleaning liquid, a treatment liquid comprising a solution containing chemical species of oxidation nature produced by said sulfuric acid electrolytic cell; and a circulation line arranged between said cleaning tank and said sulfuric acid electrolytic cell to recycle said treatment liquid.

11. A sulfuric acid recycle type cleaning system applying a sulfuric acid electrolytic cell, comprising: a sulfuric acid electrolytic cell as defined in claim 5; a cleaning tank, wherein said cleaning tank washes cleaning objects using, as a cleaning liquid, a treatment liquid comprising a solution containing chemical species of oxidation nature produced by said sulfuric acid electrolytic cell; and a circulation line arranged between said cleaning tank and said sulfuric acid electrolytic cell to recycle said treatment liquid.

12. A sulfuric acid recycle type cleaning system applying a sulfuric acid electrolytic cell, comprising: a sulfuric acid electrolytic cell as defined in claim 6; a cleaning tank, wherein said cleaning tank washes cleaning objects using, as a cleaning liquid, a treatment liquid comprising a solution containing chemical species of oxidation nature produced by said sulfuric acid electrolytic cell; and a circulation line arranged between said cleaning tank and said sulfuric acid electrolytic cell to recycle said treatment liquid.

* * * * *